US010323871B2

(12) United States Patent
Oh

(10) Patent No.: US 10,323,871 B2
(45) Date of Patent: Jun. 18, 2019

(54) METHOD FOR DIAGNOSING ICE-MAKING APPARATUS

(71) Applicant: DAEYEONG E&B Co., Ltd., Ansan-si, Gyeonggi-do (KR)

(72) Inventor: Seoung Hun Oh, Siheung-si (KR)

(73) Assignee: DAEYEONG E&B CO., LTD., Ansan-si, Gyeonggi-do (KR)

( * ) Notice: Subject to any disclaimer, the term of this patent is extended or adjusted under 35 U.S.C. 154(b) by 0 days.

(21) Appl. No.: 15/675,590

(22) Filed: Aug. 11, 2017

(65) Prior Publication Data

US 2018/0164016 A1 Jun. 14, 2018

(30) Foreign Application Priority Data

Dec. 9, 2016 (KR) ..... 10-2016-0167260

(51) Int. Cl.
*F25C 5/02* (2006.01)
*F25C 1/12* (2006.01)
(Continued)

(52) U.S. Cl.
CPC ..... *F25C 5/02* (2013.01); *F25B 49/005* (2013.01); *F25C 1/12* (2013.01); *F25C 5/18* (2013.01);
(Continued)

(58) Field of Classification Search
CPC ..... F25C 2500/00; F25C 2500/06; F25C 2500/08; F25C 2600/00; F25C 2500/02; F25C 2500/04; F25C 2700/00
See application file for complete search history.

(56) References Cited

U.S. PATENT DOCUMENTS 4,774,814 A * 10/1988 Yingst ..... F25C 1/12 62/126
5,090,210 A * 2/1992 Katayanagi ..... F25C 1/04 62/135
(Continued)

FOREIGN PATENT DOCUMENTS

JP 11-51527 A 2/1999
KR 10-2003-0015056 A 2/2003
(Continued)

OTHER PUBLICATIONS

Office Action dated Oct. 19, 2017 of corresponding Korean Patent Application No. 10-2016-0167260—6 pages.
(Continued)

*Primary Examiner* — Jonathan Bradford
(74) *Attorney, Agent, or Firm* — Knobbe Martens Olson & Bear LLP

(57) ABSTRACT

There is provided a method for diagnosing an ice-making apparatus, wherein the ice-making apparatus includes a control unit and a display unit, wherein the method comprises: determining, by the control unit, whether a diagnosis-initiation condition for the ice-making apparatus is satisfied or not; upon determination that the diagnosis-initiation condition for the ice-making apparatus is satisfied, counting, by the control unit, an actual number of ice forming and removing cycles performed by the ice-making apparatus; and displaying the counted number on the display unit by the control unit.

6 Claims, 3 Drawing Sheets

(51) Int. Cl.
*F25C 5/18* (2018.01)
*F25B 49/00* (2006.01)

(52) U.S. Cl.
CPC ..... *F25C 2400/14* (2013.01); *F25C 2500/08* (2013.01); *F25C 2600/02* (2013.01); *F25C 2700/04* (2013.01); *F25D 2400/36* (2013.01)

(56) References Cited

U.S. PATENT DOCUMENTS

| | | | | |
|---|---|---|---|---|
| 5,477,694 | A | 12/1995 | Black et al. | |
| 5,829,257 | A * | 11/1998 | Newman | F25C 5/10 62/73 |
| 7,310,957 | B2 * | 12/2007 | Broadbent | F25C 5/00 62/129 |
| 2001/0039804 | A1 | 11/2001 | Newman et al. | |
| 2004/0194480 | A1 | 10/2004 | Kim et al. | |
| 2016/0334157 | A1 * | 11/2016 | Broadbent | F25C 5/10 |

FOREIGN PATENT DOCUMENTS

| | | | |
|---|---|---|---|
| KR | 10-2005-0083744 | A | 8/2005 |
| KR | 20-2009-0005849 | U | 6/2009 |
| KR | 10-2012-0062498 | A | 6/2012 |
| KR | 10-2014-0045325 | A | 4/2014 |

OTHER PUBLICATIONS

Notice of Allowance of corresponding Korean Patent Application No. 10-2016-0167260—2 pages (dated Jul. 20, 2018).

* cited by examiner

【FIG. 1】
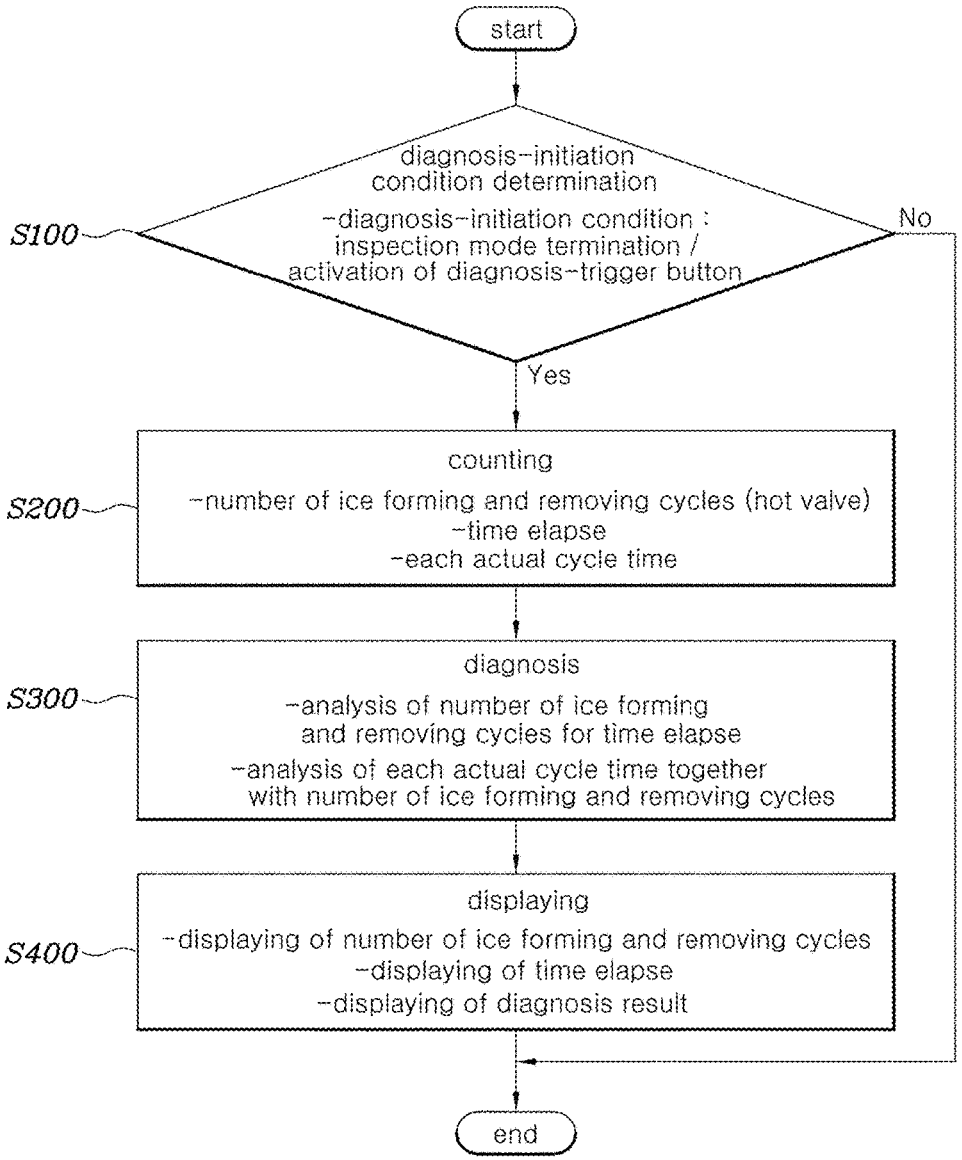

【FIG. 2】
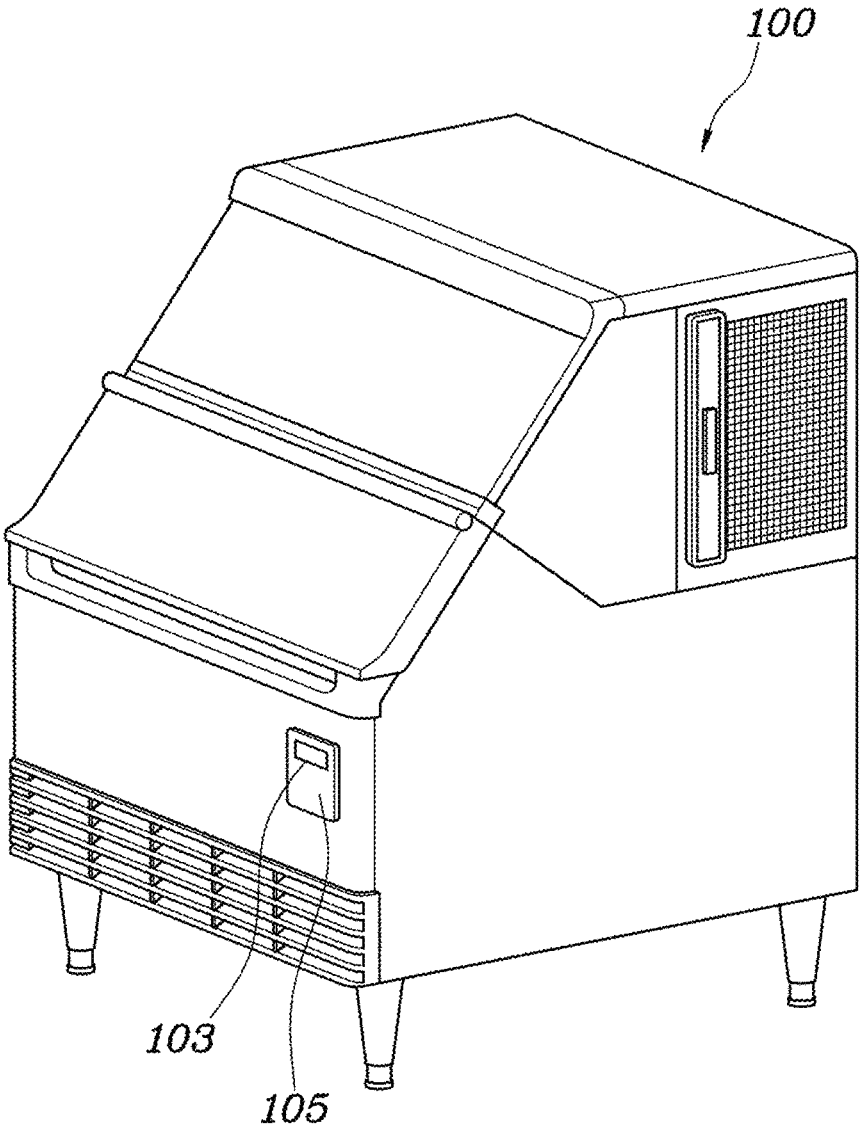

[FIG. 3]
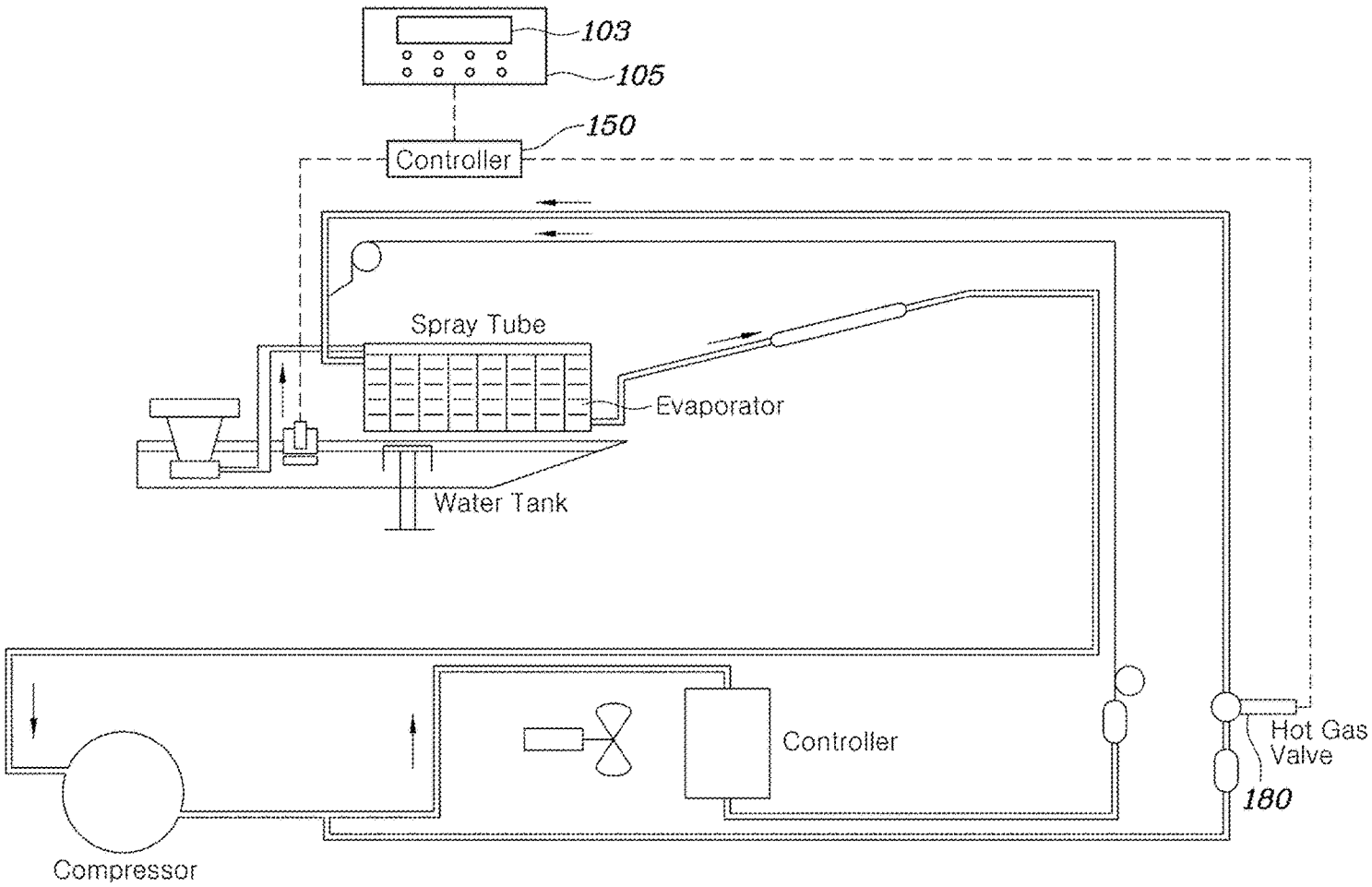

METHOD FOR DIAGNOSING ICE-MAKING APPARATUS

CROSS REFERENCE TO RELATED APPLICATION

The present application claims priority to Korean Patent Application No. 10-2016-0167260, filed on Dec. 9, 2016, the entire contents of which is incorporated herein for all purposes by this reference.

BACKGROUND

Field of the Present Disclosure

The present disclosure relates to a method for diagnosing an ice-making apparatus, and more particularly, to a method for determining an abnormality of an ice-making apparatus.

Discussion of Related Art

The ice-making apparatus cools water to produce ice, and may be classified into residential and commercial types. The ice-making apparatus performs an ice forming and removing cycles at regular intervals.

In the event of an abnormality of the ice-making apparatus, it is important to check an abnormal state of the ice forming and removing cycle. In particular, it is further important to determine whether the ice-making apparatus is performing the ice forming and removing cycle in a normal state after inspection and repair thereof due to the abnormality of the ice-making apparatus.

It should be understood that the foregoing description in this background section is merely for the purpose of promoting an understanding of the background of the present disclosure and is not to be construed as an admission that the foregoing description is considered as a prior art as known to those skilled in the art.

SUMMARY

This Summary is provided to introduce a selection of concepts in a simplified form that are further described below in the Detailed Description. This Summary is not intended to identify all key features or essential features of the claimed subject matter, nor is it intended to be used alone as an aid in determining the scope of the claimed subject matter.

The present disclosure is to provide a method for diagnosing an ice-making apparatus to effectively determine whether the ice-making apparatus is operating normally.

In a first aspect of the present disclosure, there is provided a method for diagnosing an ice-making apparatus, wherein the ice-making apparatus includes a control unit and a display unit, wherein the method comprises: determining, by the control unit, whether a diagnosis-initiation condition for the ice-making apparatus is satisfied or not; upon determination that the diagnosis-initiation condition for the ice-making apparatus is satisfied, counting, by the control unit, an actual number of ice forming and removing cycles performed by the ice-making apparatus; and displaying the counted number on the display unit by the control unit.

In one implementation, determining, by the control unit, whether a diagnosis-initiation condition for the ice-making apparatus is satisfied or not comprises determining, by the control unit, that the diagnosis-initiation condition for the ice-making apparatus is satisfied in an event that an inspection mode in which the ice-making apparatus is disassembled and assembled is terminated.

In one implementation, the ice-making apparatus includes a manipulation interface, wherein determining, by the control unit, whether a diagnosis-initiation condition for the ice-making apparatus is satisfied or not comprises determining, by the control unit, that the diagnosis-initiation condition for the ice-making apparatus is satisfied in an event that a diagnosis-trigger button on a manipulation interface is activated.

In one implementation, the ice-making apparatus includes a hot-gas valve, wherein counting, by the control unit, the number of ice forming and removing cycles performed by the ice-making apparatus comprises counting, by the control unit, the number of opening the hot-gas valve in ice-removing operations of the ice forming and removing cycles.

In one implementation, counting, by the control unit, the number of ice forming and removing cycles performed by the ice-making apparatus further comprises counting a time elapse between a start time to counter the number of ice forming and removing cycles performed by the ice-making apparatus and a current time.

In one implementation, the method further includes: calculating, by the control unit, a normal expected range of a number of ice forming and removing cycles for the time elapse, wherein the normal expected range is defined by a normal expected number of ice forming and removing cycles in a normal state of the ice-making apparatus for the time elapse and a first predetermined tolerance; and determining whether the actual number of ice forming and removing cycles performed by the ice-making apparatus is in the normal expected range, thereby to determine whether the ice-making apparatus is in a normal or abnormal state based on the determination, wherein displaying the counted number on the display unit by the control unit further comprises displaying the determination result of the normal or abnormal state of the apparatus on the display unit by the control unit.

In one implementation, counting, by the control unit, the number of ice forming and removing cycles performed by the ice-making apparatus further comprises counting, by the control unit, an actual cycle time of each of the ice forming and removing cycles performed by the ice-making apparatus, wherein the method further comprises: determining whether each actual cycle time of each of the ice forming and removing cycles is in a range of a normal expected cycle time range corresponding to a single ice forming and removing cycle, wherein the normal expected cycle time range is associated with a normal state of the apparatus; computing a number of the ice forming and removing cycles having the actual cycle times not being in the range of the normal expected cycle time range respectively; and determining whether the computed number exceeds a predetermined value, thereby to determine whether the ice-making apparatus is in a normal or abnormal state based on the determination.

In a second aspect of the present disclosure, there is provided a computer-readable storage medium having stored thereon a computer program comprising instructions, wherein the instructions, when executed by one or more processors of a computer device, causes the one or more processors to perform operations of a method for diagnosing an ice-making apparatus, wherein the ice-making apparatus includes a display unit, wherein the operations comprises: determining whether a diagnosis-initiation condition for the ice-making apparatus is satisfied or not; upon determination that the diagnosis-initiation condition for the ice-making apparatus is satisfied, counting an actual number of ice forming and removing cycles performed by the ice-making apparatus; and displaying the counted number on the display unit.

According to embodiments of the present invention, the normal or abnormal operating state of the ice-making apparatus can be grasped simply and effectively.

According to embodiments of the present invention, the actual number of ice forming and removing cycles and the elapsed time are displayed on the display unit, so that the operator can efficiently determine whether the ice forming and removing cycle is normally performed.

According to embodiments of the present invention, by measuring the number of times of opening the hot-gas valve and, thus, the number of the ice forming and removing cycle, it is possible to accurately and effectively determine the operation state of the apparatus based on the number of the ice forming and removing cycle.

According to embodiments of the present invention, by analyzing the number of ice forming and removing cycles together with the actual cycle time of each of the ice forming and removing cycles, the operating state analysis of the ice-making apparatus may be made more reliably.

BRIEF DESCRIPTION OF THE DRAWINGS

FIG. 1 is a flow diagram illustrating a method for diagnosing an ice-making apparatus according to an embodiment of the present invention;

FIG. 2 is a view illustrating a manipulation interface and a display unit provided on an ice-making apparatus in association with a method for diagnosing an ice-making apparatus according to an embodiment of the present invention; and FIG. 3 is a schematic diagram of a system for diagnosing an ice-making apparatus according to an embodiment of the present invention.

DETAILED DESCRIPTIONS

Examples of various embodiments are illustrated and described further below. It will be understood that the description herein is not intended to limit the claims to the specific embodiments described. On the contrary, it is intended to cover plate alternatives, modifications, and equivalents as may be included within the spirit and scope of the present disclosure as defined by the appended claims.

Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, terms "unit" and "module" refer to means that processes at least one function or operation, and may be implemented in hardware, software, or a combination thereof.

In embodiments of the present invention, each component, function block or means may include one or more sub-components, function sub-blocks, or sub-means. Electrical and electronic functions performed by each component may be implemented with well-known electronic circuits, integrated circuits, or ASICs (Application Specific Integrated Circuits), or the like. The electrical and electronic functions may be implemented separately or in a combination thereof.

Further, each block of the accompanying block diagrams, and each step of the accompanying flowchart may be performed by computer program instructions. These computer program instructions may be embedded within a processor of a general purpose computer, a special purpose computer, or other programmable data processing devices. Thus, the instructions when executed by the processor of the computer or other programmable data processing device will generate means for performing a function described in each block of the block diagram or each step of the flow chart.

These computer program instructions may be stored in a computer usable or computer readable memory coupled to the computer or other programmable data processing device to implement the functions in a particular manner. As such, the instructions stored in such a computer-usable or computer-readable memory enable the production of articles with instruction means that perform a function described in each block of the block diagram or each step of the flow chart.

Referring to FIG. 1 to FIG. 3, an ice-making apparatus 100 includes a control unit 150 and a display unit 103. A method for diagnosing an ice-making apparatus comprises: determining, by the control unit 150, whether a diagnosis-initiation condition for the ice-making apparatus is satisfied or not S100; upon determination that the diagnosis-initiation condition for the ice-making apparatus 100 is satisfied, counting, by the control unit 150, the number of ice forming and removing cycles performed by the ice-making apparatus 100 S200; and displaying the counted number on the display unit 103 by the control unit 150 S400.

More specifically, in the diagnosis-initiation condition determination operation S100, the control unit 150 may be configured to determine whether a diagnosis-initiation condition for the ice-making apparatus 100 is satisfied or not.

In embodiments, before a diagnosis for the ice-making apparatus 100 is performed, the control unit 150 determines whether the ice-making apparatus 100 currently meets a condition for triggering the diagnosis for the ice-making apparatus 100. In this connection, the diagnosis-initiation condition may vary.

In one embodiment, in an event that the ice-making apparatus 100 is powered off for inspection and repair thereof, and then is powered on again, and thus an ice forming and removing cycle thereof starts, the control unit 150 determines that the diagnosis-initiation condition for the ice-making apparatus 100 is met. In another embodiment, in an event that a diagnosis-trigger button on a manipulation interface 105 provided on the ice-making apparatus 100 is activated, the control unit 150 determines that the diagnosis-initiation condition for the ice-making apparatus 100 is met.

As used herein, the diagnosis is to determine if the ice forming and removing cycle operates normally, in embodiments, whether the ice forming and removing cycle is being performed as designed. In a situation where an abnormal state of the ice-making apparatus 100 is suspected, the diagnosis according to embodiments of the present invention may be required. Further, when the abnormal state of the ice-making apparatus 100 is confirmed, and thereafter, it has checked and repaired, the diagnosis according to embodiments of the present invention may be required to determine whether or not the ice-making apparatus 100 has returned to the normal state.

As for the counting operation S200, upon determination that the diagnosis-initiation condition for the ice-making apparatus 100 is satisfied, the control unit 150 may be configured to count the number of ice forming and removing cycles performed by the ice-making apparatus 100. In this connection, each of the ice forming and removing cycles includes an ice-forming operation an ice-removing operation.

In the ice-forming operation, water on a cold plate is cooled to produce ice. In the ice-removing operation, the generated ice is removed from the cold plate.

The ice-making apparatus 100 includes a cooling system using a refrigerant. The cold plate is mounted on an evaporator of the cooling system. The ice-making apparatus 100 includes a water circulation system for supplying water to the cold plate.

In this way, the ice forming and removing cycles are performed in a predefined flow. In accordance with embodiments of the present invention, upon determination that the diagnosis-initiation condition for the ice-making apparatus 100 is satisfied, the control unit 150 counts the number of ice-forming and removing cycles for the ice-making apparatus 100 S200.

It may be recognized by the control unit 105 that a diagnosis start time corresponds to a time when it is confirmed that, in the diagnosis-initiation condition determination operation S100, the diagnosis-initiation condition of the ice-making apparatus 100 is satisfied. An end point of the diagnosis may not be set separately. Alternatively, the control unit 150 may recognize the diagnosis end point as a time point when the diagnosis-trigger button on the manipulation interface 105 is turned off.

In the displaying operation S400, the control unit 150 enables the display unit 103 to display thereon the counted number of ice forming and removing cycles performed by the ice-making apparatus 100. The display unit 103 may be disposed on the manipulation interface 105. However, the present invention is not limited thereto.

The counted number of ice forming and removing cycles performed by the ice-making apparatus 100 may refer to the number of ice forming and removing cycles performed by the ice-making apparatus 100 until a current time. The number of ice forming and removing cycles performed by the ice-making apparatus 100 may be used to determine the normal or abnormal state of the ice-making apparatus 100 in various manners.

In one embodiment, when the end point of the diagnosis is not set separately, the user or the control unit may determine a life span of the ice-making apparatus 100 based on the counted number of the ice forming and removing cycles displayed on the display unit 103.

Further, the user or the control unit 105 may determine an abnormality state of the ice-making apparatus 100 based on the counted number of ice forming and removing cycles performed by the ice-making apparatus 100. In one embodiment, when the abnormality of the ice-making apparatus 100 is suspected and thus, the diagnosis-trigger button on the manipulation interface 105 is activated by the user, the user or the control unit 105 may determine whether the number of ice-forming and removing cycles performed by the ice-making apparatus 100 from the start time of diagnosis to a current time is normal.

More specifically, an elapsed time from the start of diagnosis to the current time is counted. A time taken to perform a single ice forming and removing cycle as preset for the ice-making apparatus 100 is considered. In this way, in the normal state, a normal expected number of ice forming and removing cycles from the diagnosis start to the current time may be derived. This normal expected number is compared with the actual number of ice forming and removing cycles, as which is indicated on the display unit 103. Based on the comparison result, the abnormal state of the ice-making apparatus 100 can be determined.

The method for diagnosing the ice-making apparatus 100 according to embodiments of the present invention may be particularly useful after the inspection and repair of the ice-making apparatus 100. Once the failure of the ice-making apparatus 100 is identified, an internal configuration of the ice-making apparatus 100 is inspected and repaired.

When the internal configuration of the ice-making apparatus 100 has been inspected and repaired, in embodiments, it may be necessary to determine whether the repair of the ice-making apparatus 100 is successful. In this case, the method for diagnosing the ice-making apparatus 100 according to embodiments of the present invention may be used to determine whether the repair of the ice-making apparatus 100 is successful.

In one embodiment, when the internal configuration of the ice-making apparatus 100 has been inspected and repaired and the ice-making apparatus 100 starts to operate, the control unit 150 may count the actual number of ice forming and removing cycles performed by the ice-making apparatus 100 and may enable the display unit 103 to display thereon the actual number. An operator may measure an elapsed time from the start time to the current time, and calculate a normal expected number of ice forming and removing cycles from the start time to the current time based on the elapsed time. The operator may compare this normal expected number with the actual number of ice forming and removing cycles, as which is indicated on the display unit 103.

When the actual number of ice forming and removing cycles is different from the normal expected number thereof, it may be determined that the ice-making apparatus 100 is in an abnormal state. This means that the inspection and repair for the ice-making apparatus 100 is not successful.

Otherwise, when the actual number of ice forming and removing cycles match the normal expected number thereof, it may be determined that the ice-making apparatus 100 is in a normal state. This means that the inspection and repair for the ice-making apparatus 100 is successful. Thus, reliability of the maintenance and inspection of the ice-making apparatus 100 can be improved.

Further, while the diagnosis of the ice forming and removing cycle is being performed, the operator may perform other tasks. This allows time-efficient maintenance and inspection of the ice-making apparatus 100.

According to embodiments of the present invention, the control unit 150 diagnoses an abnormality of the ice-making apparatus 100, in particular, using the counted number of ice forming and removing cycles performed by the ice-making apparatus 100. This is due to the fact that the abnormality of the ice-making apparatus ultimately affects the time required for the ice forming and removing cycles.

For example, if there is a problem on the water circulation system, the water will not be able to flow smoothly to the cold plate. This can increase the time required for the ice forming and removing cycles. Further, even if there is a problem with the cooling system, the temperature of the cold plate does not reach the preset temperature. This leads to an increase in the time required for the ice forming and removing cycles.

Furthermore, if the ice-making apparatus 100 has an inoperability, this may also lead to an increase in the time required for the ice forming and removing cycles. Therefore, in accordance with embodiments of the present invention, the control unit 150 may be configured to diagnose the abnormality of the ice-making apparatus 100, particularly on the basis of the time required for the ice forming and removing cycle or the actual counted number of ice forming and removing cycles.

In embodiments of the present invention, the time required for the ice forming and removing cycles is used as a measure indicating the abnormality of the ice-making apparatus 100. When the diagnosis-initiation condition is satisfied, the ice-making apparatus 100 starts operating. The number of ice forming and removing cycles performed by the ice-making apparatus 100 is measured by the control unit 150 and then displayed on the display unit 103. Thereby, the inspector, the user or the control unit can simply and effectively diagnose whether or not the ice-making apparatus 100 is in a normal state.

FIG. 1 is a flowchart illustrating a method for diagnosing the ice-making apparatus 100 according to embodiments of the present invention. FIG. 2 shows the ice-making apparatus 100 provided with the manipulation interface 105 and the display unit 103 as described above. The manipulation interface 105 and the display unit 103 will be described in detail later.

FIG. 3 is a diagram illustrating a system for diagnosing the ice-making apparatus 100 according to embodiments of the present invention. In FIG. 3, the cooling system and the water circulation system are schematically shown, and the control unit 150 is also shown.

Referring to FIG. 1, the method for diagnosing the ice-making apparatus 100 may include the diagnosis-initiation condition determination operation S100. In one embodiment, determining, by the control unit 150, whether the diagnosis-initiation condition for the ice-making apparatus 100 is satisfied or not may comprise determining, by the control unit 150, that the diagnosis-initiation condition for the ice-making apparatus 100 is satisfied in an event that an inspection mode in which the ice-making apparatus 100 is disassembled and assembled is terminated.

In one embodiment, the control unit 150 may recognize a situation in which the power of the ice-making apparatus 100 is shut off and then powered back, as the inspection mode termination event. In another embodiment, the control unit 150 may recognize a situation in which the abnormality of the ice-making apparatus 100 has previously been determined, and, thus, the ice-making apparatus 100 is powered off and then back on, as the inspection mode termination event.

In one embodiment, the manipulation interface 105 may include an inspection button for checking and repairing the ice-making apparatus 100. In this case, when the inspection button is activated, the control unit 150 may recognize the inspection button activation as an inspection mode activation event. Then, when the inspection button is deactivated, the control unit 150 may recognize this as the inspection mode termination event. This inspection mode termination event may correspond to an event where the diagnosis-initiation condition is met.

According to an embodiment of the present invention, the control unit 150 may recognize the inspection mode termination event of the ice-making apparatus 100 as the event of the diagnosis-initiation condition being met. Thus, unnecessary diagnosis is not performed and diagnosis of the ice-making apparatus 100 may be efficiently performed.

In one embodiment, determining, by the control unit 150, whether a diagnosis-initiation condition for the ice-making apparatus is satisfied or not may comprise determining, by the control unit 150, that the diagnosis-initiation condition for the ice-making apparatus is satisfied in an event that a diagnosis-trigger button on the manipulation interface 105 is activated.

In one embodiment, the ice-making apparatus 100 includes the manipulation interface 105. When the diagnosis-trigger button on the manipulation interface 105 is activated by the user or operator, the control unit 150 may be configured to determine that the diagnosis-initiation condition is met.

The manipulation interface 105 may be provided at various positions of the ice-making apparatus 100. For example, the manipulation interface 105 may be provided inside the ice-making apparatus 100. In this case, the manipulation interface 105 may be exposed and manipulated via disassembly of the ice-making apparatus 100. In another embodiment, the manipulation interface 105 may be provided such that at least a portion of the manipulation interface 105 is exposed outside the ice-making apparatus 100. The exposed portion of the manipulation interface 105 may be provided with a plurality of buttons that may be manipulated by the user or the examiner. More preferably, the display unit 103 may be positioned adjacent to the manipulation interface 105 or mounted on the manipulation interface 105. In FIG. 2, the ice-making apparatus 100 is shown which is provided with the manipulation interface 105 and the display unit 103 as described above.

In an embodiment of the present invention, the control unit 150 may determine the diagnostic intent of the user or the inspector requesting diagnosis of the ice-making apparatus 100 based on the activation state of the diagnosis-trigger button of the manipulation interface 105. Thus, unnecessary diagnosis is not performed, and the diagnosis of the ice-making apparatus 100 may be efficiently performed.

Referring to FIG. 1 to FIG. 3, the method for diagnosing an ice-making apparatus according to an embodiment of the present invention includes the counting operation S200. In this connection, the control unit 150 counts the number of opening of the hot-gas valve 180 in the ice-removing operation of the ice forming and removing cycle, thereby to count the number of ice forming and removing cycles performed by the ice-making apparatus 100.

In one embodiment, counting the number of ice forming and removing cycles performed by the ice-making apparatus 100 may include counting the number of the ice-removing operations performed by the ice-making apparatus 100.

In the ice forming and removing cycle, the ice-forming operation may take more time than the ice-removing operation. Thus, it is not easy to configure a hardware-related control feature capable of specifying the ice-forming operation.

For example, during the ice-forming operation, water is supplied to the cold plate of the ice-making apparatus 100. However, the supply of water continues to occur in the ice-forming operation. Thus, this supply of water may not be considered a typical feature to specify the ice-forming operation.

In the embodiment of the present invention, in consideration of the above, the number of times the hot-gas valve 180 is opened in the ice-removing operation of the ice forming and removing cycle is counted. The opening count of the hot-gas valve 180 may correspond to the number of the ice forming and removing cycles. The ice-making apparatus 100 according to embodiments of the present invention uses the hot gas to remove ice from the cold plate.

The hot gas is supplied from a compressor of the cooling system and then bypasses a condenser thereof. There is provided a hot gas flow channel for flowing the hot gas from the compressor to the evaporator equipped with the cold plate. The hot-gas valve 180 is provided in the hot gas flow channel. Such a configuration is shown in FIG. 3.

In order for the ice-removing operation to be performed, the hot-gas valve 180 is opened. The opening of the hot-gas valve 180 is controlled by the control unit 150. In embodiments, the control unit 150 may count the number of times the hot-gas valve 180 is opened. Thus, the control unit 150 may determine the number of ice forming and removing cycles performed by the ice-making apparatus 100 based on the number of the opening of the valve 180.

In one embodiment, the number of ice forming and removing cycles performed by the ice-making apparatus 100 may be measured based on the count of the opening of the hot-gas valve 180. Thus, while the control unit 150 performs complicated control, the control unit may accurately calculate the number of ice forming and removing cycles performed by the ice-making apparatus 100.

Referring to FIG. 1, the counting operation S200 in the method for diagnosing an ice-making apparatus 100 may further include counting, by the control unit 150, the time elapse between a start time to count the number of ice forming and removing cycles and a current time.

As described above, in accordance with embodiments of the present invention, the control unit 150 determines, based on the elapsed time, the normal expected number of the ice forming and removing cycles as pre-designed, and compares the normal expected number and the actual number of the ice forming and removing cycles as performed by the ice-making apparatus 100, thereby diagnosing the abnormality of the ice-making apparatus 100 based on the comparison.

In an embodiment of the present invention, therefore, the elapsed time since the diagnosis has been performed may be counted by the control unit 150 in order to facilitate such diagnosis. It may be non-preferable for the user or the operator to calculate the elapsed time by himself or herself because the user or operator may mistake in determining the diagnosis start point.

Thus, in an embodiment of the present invention, the control unit 150 counts the elapsed time and diagnoses the ice-making apparatus 100 based on the elapsed time. The elapsed time may be variously used.

In one embodiment, the elapsed time may be displayed directly on the display unit 103. Thereby, the user or the operator may be given convenience for confirming the diagnosis result. Furthermore, the control unit 150 will be able to determine the abnormal state of the apparatus 1 based on the elapsed time. This will be described below.

Referring to FIG. 1 and FIG. 2, the method for diagnosing an ice-making apparatus may include a diagnosis operation S300 subsequent to the counting operation S200. In the diagnosis operation S300, the control unit 150 may determine whether the number of ice forming and removing cycles performed by the ice-making apparatus 100 for the elapsed time is in a normal range.

In the displaying operation S400, the control unit 150 may enable the display unit 103 to display thereon the actual number of ice forming and removing cycles performed by the ice-making apparatus 100 and the diagnosis result of the ice-making apparatus 100.

Specifically, the control unit 150 may analyze the number of ice forming and removing operations performed by the ice-making apparatus 100 based on the elapsed time. The diagnostic method based on this elapsed time may be various. In one embodiment of the present invention, the control unit 150 determines a normal expected number of ice forming and removing cycles in a normal state of the ice-making apparatus 100 based on the elapsed time. Thereafter, the control unit 150 compares the actual counted number of ice forming and removing cycles with the normal expected number of ice forming and removing cycles.

A single ice forming and removing cycle of the ice-making apparatus 100 may have a predetermined unit time. The normal expected number of the ice forming and removing cycles may be derived based on the predetermined unit time and the elapsed time to the current time. In an embodiment of the present invention, this normal expected number corresponds to the normal range of the number of ice forming and removing cycles.

In this connection, the normal range of the number of ice forming and removing cycles may further have a tolerance due to various factors. Thus, the normal range of the number of ice forming and removing cycles may not be exactly equal to the normal expected number but about the normal expected number due to the tolerance. The tolerance may be determined experimentally and/or statistically.

For example, depending on the cold plate temperature inside the evaporator of the ice-making apparatus 100, the expected time required for the single ice forming and removing cycle may be slightly changed. Thus, the normal range may be determined with reflecting the tolerance due to the temperature change.

The control unit 150 determines whether the actual counted number of ice forming and removing cycles is in the normal expected range and, thereby, diagnoses an abnormality of the ice-making apparatus 100 based on the determination. If the actual counted number of ice forming and removing cycles is in the normal expected range, the control unit 150 may allow the display unit 103 to indicate that the ice-making apparatus 100 is in a normal state in the displaying operation S400.

Referring to FIG. 1, the method for diagnosing an ice-making apparatus may include the diagnosis operation S300. In the counting operation S200, the control unit 150 may measure the number of ice forming and removing cycles performed by the apparatus 1 until the current time and the time elapse between the start time of measuring the number and the current time. The diagnosis operation S300 may include comparing, by the control unit 150, the normal expected range of the ice forming and removing cycle and the actual measured number of the ice forming and removing cycles performed by the ice-making apparatus 100; and determine whether the actual number of ice forming and removing cycles performed by the ice-making apparatus 100 is in a range of the normal expected range, thereby to determine whether the ice-making apparatus 100 is in an abnormal state based on the determination.

In an embodiment of the present invention, the control unit determines the abnormal state of the ice-making apparatus 100 using each time spent for each ice forming and removing cycle as performed by the ice-making apparatus 100, in addition to the total elapsed time for which the diagnosis was performed.

A normal cycle time required for a single ice forming and removing cycle as expected in the normal state of the ice-making apparatus 100 may be preset into the control unit 150. In an embodiment of the present invention, the control unit counts the actual number of ice forming and removing cycles as performed by the ice-making apparatus 100, and, concurrently, measures each actual cycle time spent for each ice forming and removing cycle as performed by the ice-making apparatus 100.

In one embodiment, each cycle time spent for each ice forming and removing cycle as performed by the ice-making apparatus 100 may be obtained based on a start time point of each of the ice forming and removing cycles as performed by the ice-making apparatus 100. In one embodiment, the start time point of each of the ice forming and removing cycles as performed by the ice-making apparatus 100 may correspond to an opening time of the hot-gas valve 180. Thus, each time spent for each ice forming and removing cycle as performed by the ice-making apparatus 100 may be calculated as a time interval between previous and current opening times of the hot-gas valve 180

In this connection, due to various factors including variations in temperature of the cold plate, the normal cycle time required for a single ice forming and removing cycle as expected in the normal state of the ice-making apparatus 100 may have a time tolerance. Thus, each cycle time spent for each ice forming and removing cycle as performed by the ice-making apparatus 100 may be compared not to exactly the normal cycle time required for a single ice forming and removing cycle as expected in the normal state of the ice-making apparatus 100 but to a normal time range including the normal cycle time and the time tolerance.

In one embodiment, when among the actual total number of the ice forming and removing cycle, the number of the ice forming and removing cycles, each having the cycle time exceeding the normal time range, exceeds a predetermined value, the control unit may be configured to determine that the ice-making apparatus 100 is in an abnormal state.

In this connection, as described above, a predetermined time range may be embodied as a sum of the normal cycle time and the time tolerance.

In embodiments, in order to determine whether the ice-making apparatus 100 is in an abnormal state, the control unit 150 may employ each cycle time spent for each ice forming and removing cycle as performed by the ice-making apparatus 100, thereby to result in more reliable or accurate diagnosis of the ice-making apparatus 100.

In some embodiments of the present disclosure, the control unit may include a memory to store therein a program for processing and controlling operations by the control unit 150. In addition, the memory may perform a temporary storage of input/output data. Such memory may be embodied as any of known storage media.

The various embodiments described herein may be implemented in a recording medium readable by a computer or other machine, using, for example, software, hardware, or a combination thereof.

According to a hardware implementation, the embodiments described herein may be implemented using at least one of ASICs (application specific integrated circuits), DSPs (digital signal processors), DSPDs (digital signal processing devices), PLDs (programmable logic devices), FPGAs (field programmable gate arrays), processors, controllers, microcontrollers, microprocessors, and electrical units for performing other functions. In some cases, the embodiments described herein may be implemented using the control module 120 itself.

According to a software implementation, embodiments such as the procedures and functions described herein may be implemented with separate software modules. Each of the software modules may perform one or more of the functions and operations described herein. The software module may be implemented with a software application written in a suitable programming language. The software module may be stored in the memory and executed by the control unit 150.

The description of the disclosed embodiments is provided to enable any person skilled in the art to make or use the invention. Various modifications to these embodiments will be readily apparent to those skilled in the art upon reading the present disclosure. The generic principles defined herein may be applied to other embodiments without departing from the scope of the present disclosure. Thus, the present disclosure is not to be construed as limited to the embodiments set forth herein but is to be accorded the widest scope consistent with the principles and novel features presented herein.

What is claimed is:

1. A method for diagnosing an ice-making apparatus, wherein the ice-making apparatus includes a controller and a display, wherein the method comprises:

determining, by the controller, whether a diagnosis-initiation condition for the ice-making apparatus is satisfied or not;

upon determination that the diagnosis-initiation condition for the ice-making apparatus is satisfied, counting, by the controller, an actual number of ice forming and removing cycles performed by the ice-making apparatus;

displaying the counted number on the display by the controller;

counting a time elapse between a start time to count the number of ice forming and removing cycles performed by the ice-making apparatus and a current time;

calculating, by the controller, a normal expected range of the number of ice forming and removing cycles for the time elapse, wherein the normal expected range is defined based on a normal expected number of ice forming and removing cycles in a normal state of the ice-making apparatus for the time elapse;

determining whether the actual number of ice forming and removing cycles performed by the ice-making apparatus is in the normal expected range, thereby to determine whether the ice-making apparatus is in a normal or abnormal state based on the determination; and displaying the determination result of the normal or abnormal state of the apparatus on the display by the controller.

2. The method of claim 1, wherein determining, by the controller, whether a diagnosis-initiation condition for the ice-making apparatus is satisfied or not comprises determining, by the controller, that the diagnosis-initiation condition for the ice-making apparatus is satisfied in an event that an inspection mode in which the ice-making apparatus is disassembled and assembled is terminated.

3. The method of claim 1, wherein the ice-making apparatus includes a manipulation interface, wherein determining, by the controller, whether a diagnosis-initiation condition for the ice-making apparatus is satisfied or not comprises determining, by the controller, that the diagnosis-initiation condition for the ice-making apparatus is satisfied in an event that a diagnosis-trigger button on the manipulation interface is activated.

4. The method of claim 1, wherein the ice-making apparatus includes a hot-gas valve, wherein counting, by the controller, the number of ice forming and removing cycles performed by the ice-making apparatus comprises counting, by the controller, the number of opening the hot-gas valve in ice-removing operations of the ice forming and removing cycles.

5. A method for diagnosing an ice-making apparatus, wherein the ice-making apparatus includes a controller and a display, wherein the method comprises:

determining, by the controller, whether a diagnosis-initiation condition for the ice-making apparatus is satisfied or not;

upon determination that the diagnosis-initiation condition for the ice-making apparatus is satisfied, counting, by the controller, an actual number of ice forming and removing cycles performed by the ice-making apparatus;

displaying the counted number on the display by the controller; and counting, by the controller, an actual cycle time of each of the ice forming and removing cycles performed by the ice-making apparatus;

determining whether each actual cycle time of each of the ice forming and removing cycles is in a range defined based on a cycle time of a single ice forming and removing cycle in a normal state of the apparatus;

computing the number of the ice forming and removing cycles having the actual cycle times not being in the range respectively; and determining, based on the computed number, whether the ice-making apparatus is in a normal or abnormal state.

6. A non-transitory computer-readable medium having stored thereon a computer program comprising instructions, wherein the instructions, when executed by one or more processors of a computer, causes the one or more processors to perform operations of a method for diagnosing an ice-making apparatus, wherein the ice-making apparatus includes a display, wherein the operations comprises:

determining whether a diagnosis-initiation condition for the ice-making apparatus is satisfied or not;

upon determination that the diagnosis-initiation condition for the ice-making apparatus is satisfied, counting an actual number of ice forming and removing cycles performed by the ice-making apparatus; and displaying the counted number on the display, counting a time elapse between a start time to count the number of ice forming and removing cycles performed by the ice-making apparatus and a current time;

calculating a normal expected range of the number of ice forming and removing cycles for the time elapse, wherein the normal expected range is defined based on a normal expected number of ice forming and removing cycles in a normal state of the ice-making apparatus for the time elapse;

determining whether the actual number of ice forming and removing cycles performed by the ice-making apparatus is in the normal expected range, thereby to determine whether the ice-making apparatus is in a normal or abnormal state based on the determination; and displaying the determination result of the normal or abnormal state of the apparatus on the display.

* * * * *